US010386775B2

(12) United States Patent
Geshi

(10) Patent No.: US 10,386,775 B2
(45) Date of Patent: Aug. 20, 2019

(54) IMAGE-FORMING APPARATUS THE PERFORMS PRINTING ON PRINTING PAPER

(71) Applicant: KYOCERA Document Solutions Inc., Osaka (JP)

(72) Inventor: Takuya Geshi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 118 days.

(21) Appl. No.: 15/712,090

(22) Filed: Sep. 21, 2017

(65) Prior Publication Data

US 2018/0081316 A1 Mar. 22, 2018

(30) Foreign Application Priority Data

Sep. 21, 2016 (JP) ..... 2016-183995

(51) Int. Cl.
*G03G 15/00* (2006.01)
*B41J 15/04* (2006.01)
(Continued)

(52) U.S. Cl.
CPC ..... *G03G 15/6567* (2013.01); *B41J 15/046* (2013.01); *B65H 7/08* (2013.01); *B65H 9/006* (2013.01); *G03G 15/6511* (2013.01); *B65H 2511/242* (2013.01); *B65H 2513/50* (2013.01); *B65H 2553/42* (2013.01);
(Continued)

(58) Field of Classification Search
CPC ..... G03G 15/6567; G03G 15/6511; G03G 15/6564; G03G 2215/00075; G03G 2215/00561; G03G 2215/00721; G03G 2215/00763; B41J 15/046; B65H 7/08; B65H 9/006; B65H 2511/242; B65H 2513/50; B65H 2553/42; B65H 2553/81; B65H 2701/1311
See application file for complete search history.

(56) References Cited

U.S. PATENT DOCUMENTS

2003/0024792 A1* 2/2003 Yoshida ..... G06K 9/3283 198/401
2005/0212194 A1* 9/2005 Moriyama ..... B26D 7/2628 270/58.08
(Continued)

FOREIGN PATENT DOCUMENTS

JP 2007-060516 A 3/2007

*Primary Examiner* — David H Banh
(74) *Attorney, Agent, or Firm* — Hawaii Patent Services; Nathaniel K. Fedde; Kenton N. Fedde

(57) ABSTRACT

An image-forming apparatus that is capable of accurately detecting skew angle when arriving at a resist roller. In the image-forming apparatus, the resist roller feeds the printing paper to a printing unit at specified timing, and the printing unit performs printing on the printing paper. The flat-conveying section is formed between the paper-supply roller and the resist roller, and conveys the paper in a flat state. The camera takes images of the edge of the front end of the printing paper that is conveyed in the flat-conveying section. The camera-driving apparatus causes the camera to move along the flat-conveying section at the designed conveying speed of the printing paper. The skew-detection unit, based on images taken in the flat-conveying section by the camera, detects the skew angle when arriving at the resist roller as the arrival skew angle.

4 Claims, 9 Drawing Sheets

(51) Int. Cl.
*B65H 7/08* (2006.01)
*B65H 9/00* (2006.01)

(52) U.S. Cl.
CPC .. *B65H 2553/81* (2013.01); *B65H 2701/1311* (2013.01); *G03G 15/6564* (2013.01); *G03G 2215/00075* (2013.01); *G03G 2215/00561* (2013.01); *G03G 2215/00721* (2013.01); *G03G 2215/00763* (2013.01)

(56) References Cited

U.S. PATENT DOCUMENTS

2009/0134570 A1* 5/2009 Hayakawa ..... B65H 7/06 271/227
2012/0147435 A1* 6/2012 Parks ..... B65H 3/5261 358/401
2012/0262750 A1* 10/2012 Kinoshita ..... G06K 15/1247 358/1.14
2012/0262765 A1* 10/2012 Saito ..... B65H 7/08 358/488
2013/0107286 A1* 5/2013 Shukuya ..... G06K 1/00 358/1.5
2014/0193186 A1* 7/2014 Furuyama ..... G03G 15/657 399/388
2015/0281514 A1* 10/2015 Kita ..... H04N 1/00572 358/448
2015/0362881 A1* 12/2015 Tosaka ..... G03G 15/5058 399/395
2016/0221781 A1* 8/2016 Yoshida ..... B65H 9/00
2018/0093507 A1* 4/2018 Sosnowski ..... B41J 2/07

* cited by examiner

IMAGE-FORMING APPARATUS THE PERFORMS PRINTING ON PRINTING PAPER

INCORPORATION BY REFERENCE

This application is based on and claims the benefit of priority from Japanese Patent Application No. 2016-183995 filed on Sep. 21, 2016, the contents of which are hereby incorporated by reference.

BACKGROUND

The present disclosure relates to an image-forming apparatus that prints a formed toner image on conveyed printing paper.

In typical technology, when conveying printing paper, it is presumed that skewing will occur and that correction of the skewing will be performed by making a deflection using a resist roller.

SUMMARY

The image-forming apparatus according to the present disclosure is an image-forming apparatus in which a paper-supply roller conveys printing paper that is fed from a paper-supply unit by a pickup roller toward a resist roller, the resist roller feeds the printing paper to a printing unit at specified timing, and the printing unit performs printing on the printing paper. The image-forming apparatus includes a flat-conveying section, a camera, a camera-driving apparatus, and a skew-detection unit. The flat-conveying section is formed in the printing paper conveyance path between the paper-supply roller and the resist roller, and conveys the paper in a flat state. The camera takes images of the edge of the front end of the printing paper that is conveyed in the flat-conveying section. The camera-driving apparatus causes the camera to move along the flat-conveying section at the designed conveying speed of the printing paper. The skew-detection unit, based on images taken in the flat-conveying section by the camera, detects the skew angle when arriving at the resist roller as the arrival skew angle.

DETAILED DESCRIPTION

In the following, embodiments of the present disclosure will be explained in detail with reference to the drawings. In the embodiments below, the same reference numbers will be used for configuration that illustrates the same function.

Figure 1:
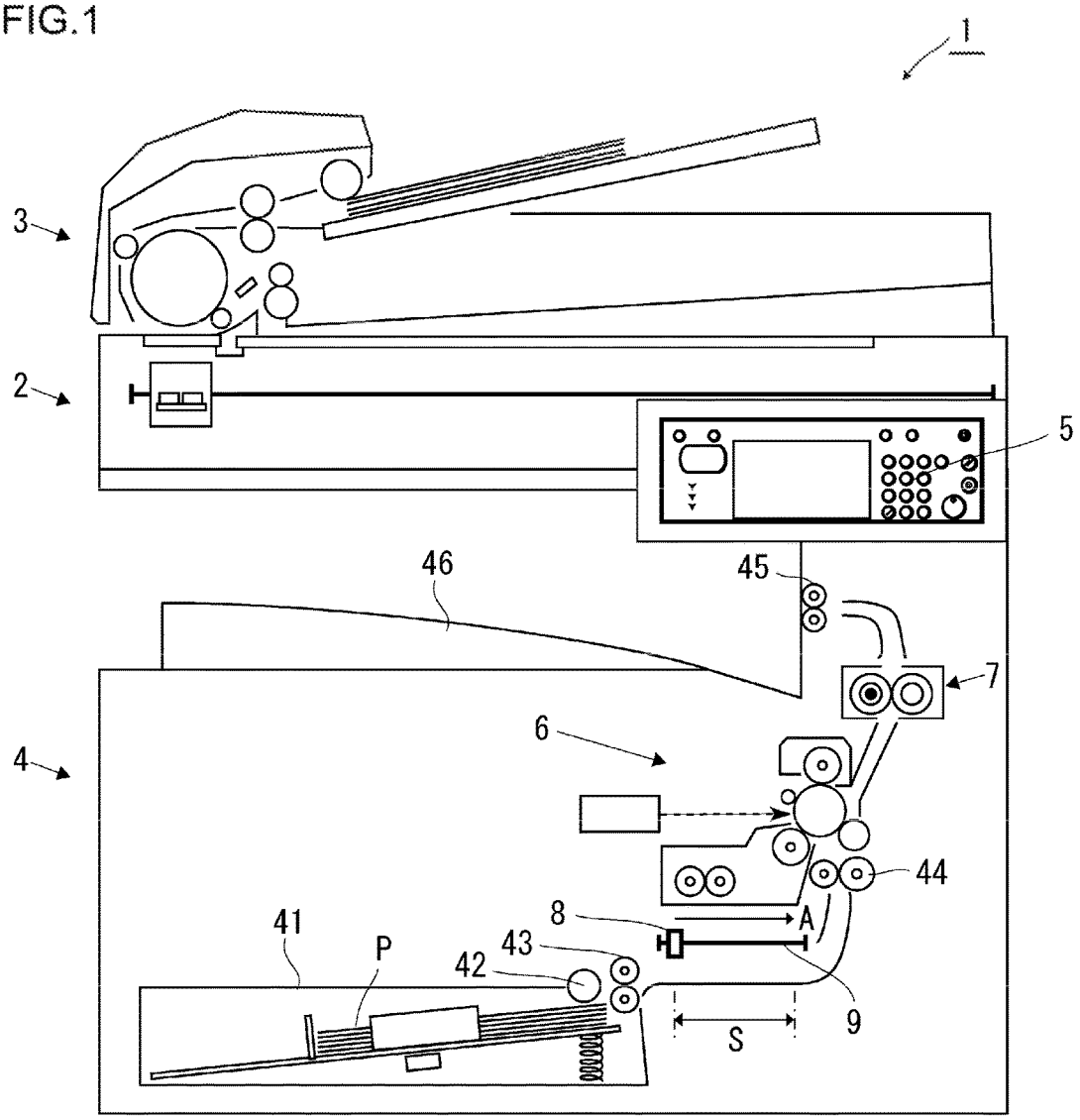
FIG. 1 is a cross-sectional schematic view of the internal configuration of an embodiment of an image-forming apparatus according to the present disclosure.

The image-forming apparatus 1 of this embodiment, with reference to FIG. 1, includes a document-reading unit 2, a document-feeding unit 3, a main unit 4, and an operation unit 5. The document-reading unit 2 is arranged on the upper portion of the main unit 4, and the document-feeding unit 3 is arranged on the upper portion of the document-reading unit 2. The operation unit 5 that includes a start key, ten-key, LCD and the like is arranged on the front side of the main unit 4.

The document-reading unit 2 includes a scanner that includes an exposure lamp, a CCD (Charge Coupled Device) sensor and the like. The document-reading unit 2 reads a document that is placed on the platen glass, or reads a document that is fed by the document-feeding unit 3, obtains image data, and outputs the obtained image data to the main unit 4.

The main unit 4 includes a printing unit 6 and a fixing unit 7, as well as includes a paper-supply unit 41, a pickup roller 42, a paper-supply roller 43, a resist roller 44, a discharge roller 45, a discharge space 46 and a camera 8. The paper-supply unit 41 is a paper-supply cassette in which plural sheets of printing paper P are stored, and is arranged at the lower portion of the main unit 4. The paper-supply roller 43 conveys printing paper P that is fed one sheet at a time from the paper-supply unit 41 by the pickup roller 42 toward the resist roller 43. The resist roller 44 feeds the printing paper P from the paper-supply unit 41 to the printing unit 6 at specified timing. The printing paper P on which printing is performed by the printing unit 6 and fixing unit 7 is discharged by the discharge roller 45 to the discharge space 46 that is formed between the document-reading unit 2 and the main unit 4.

There is a flat-conveying section S in the conveying path of the printing paper P from the paper-supply roller 43 to the resist roller 44 in which the printing paper P is conveyed in a flat shape without being bent.

The camera 8 is supported in the flat-conveying section S by a guide 9 that extends in the conveying direction of the printing paper P, and takes images of the area around the edge of the front end of the printing paper P that is conveyed while moving over the flat-conveying section S along the guide 9.

Figure 2:
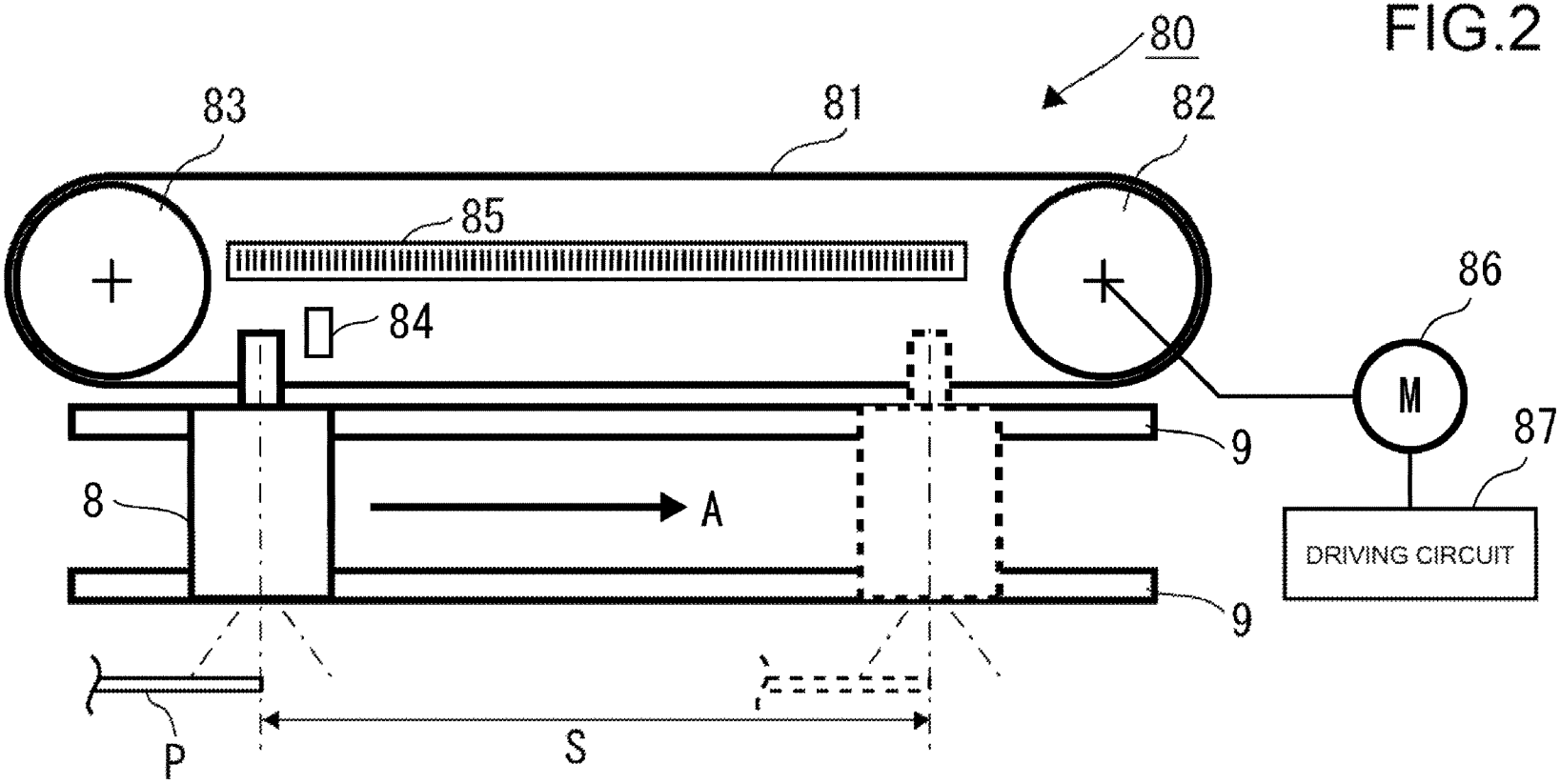
FIG. 2 illustrates a driving mechanism for the camera illustrated in FIG. 1.

FIG. 2 illustrates a camera-driving unit 80 that moves the camera 8 along the flat-conveying section. The camera-driving unit 80 includes a transmission belt 81, driving pulley 82, follower pulley 83, home-position sensor 84, a linear encoder 85, a camera motor 86, and a camera-motor-driving circuit 87.

The camera 8, as illustrated in FIG. 2, is fastened to the transmission belt 81 that is made using rubber and the like. The transmission belt 81 is placed around the driving pulley 82 to which the rotation of the camera motor 86 is transmitted, and the follower pulley 83. Displacement of the camera 8 (movement in the conveying direction of the printing paper P) is measured by the home-position sensor 84 and the linear encoder 85. The camera-motor-driving circuit 87 controls driving by the camera motor 86 based on the measured displacement of the camera 8, and moves the camera 8 in the conveying direction of the printing paper P illustrated by arrow A in FIG. 1 and FIG. 2.

Figure 3:
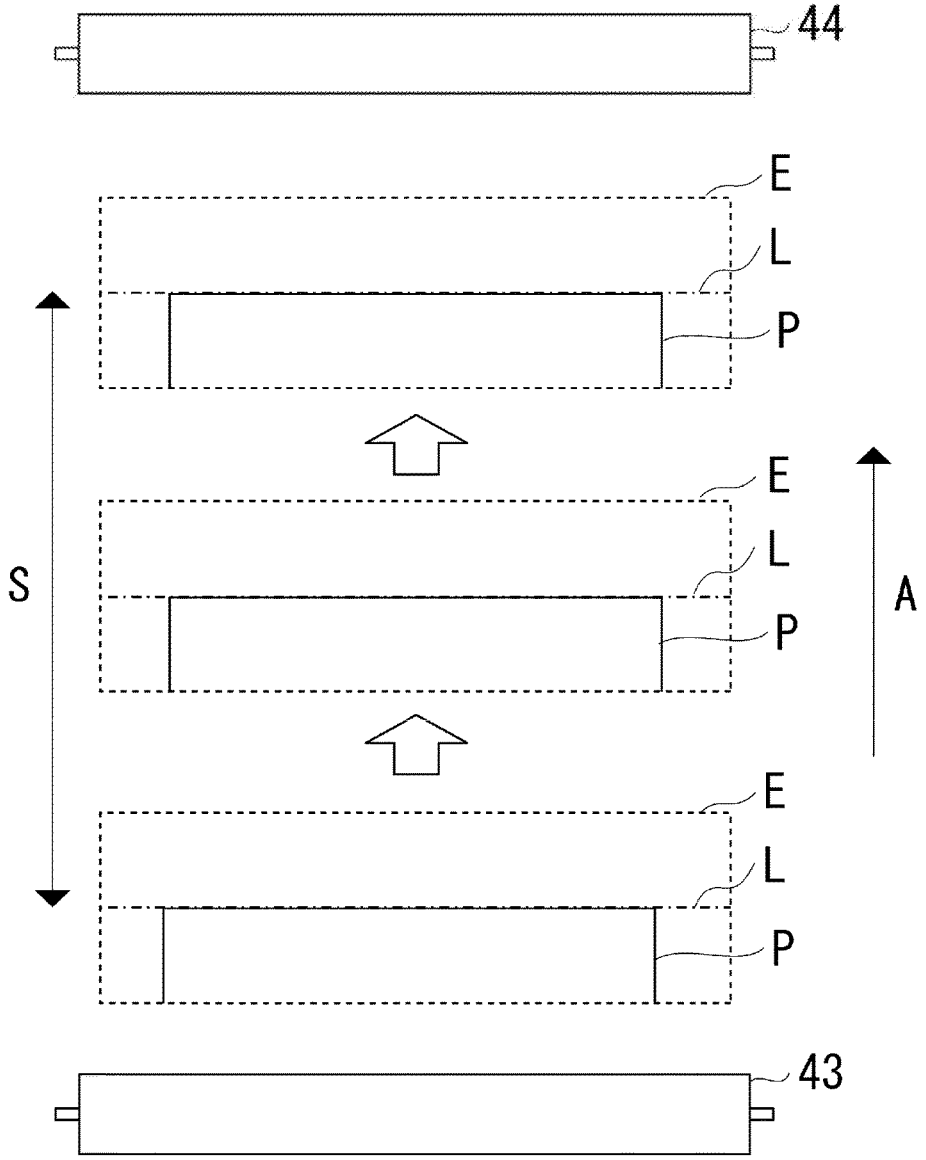
FIG. 3 is an explanatory diagram for explaining the imaging range of the camera illustrated in FIG. 1.

As illustrated in FIG. 3, the imaging range E of the camera 8 is set to the width or greater than the width of the printing paper P that is conveyed in the flat-conveying section S. Moreover, the home position of the camera 8 is set on the paper-supply roller 43 side of the flat-conveying section S. Furthermore, a reference line L that is orthogonal to the conveying direction of the printing paper P is set in the imaging range E of the camera 8. The camera 8 begins moving in the direction of the resist roller 44 at the timing when the edge of the front end of the printing paper P that is started being supplied by the pickup roller 42 and the paper-supply roller 43 reaches a reference line L that is set in the imaging range E of the camera 8 positioned at the home position. The speed of movement of the camera 8 is set to the designed conveying speed of the printing paper P by the paper-supply roller 43. Therefore, when the printing paper P is conveyed at the designed conveying speed by the paper-supply roller 43, in the flat-conveying section S, the relative position relationship between the camera 8 and the edge of the front end of the printing paper P is always the same, and as illustrated in FIG. 3, the edge of the front end of the printing paper P is positioned on the reference line L of the imaging range E of the camera 8. The camera 8 is mechanically moved by the camera-driving unit 80 without the use of rollers, so there is very little change over time of the speed. Therefore, the movement speed of the camera 8 can always be regarded to be the designed conveying speed.

Figure 4:
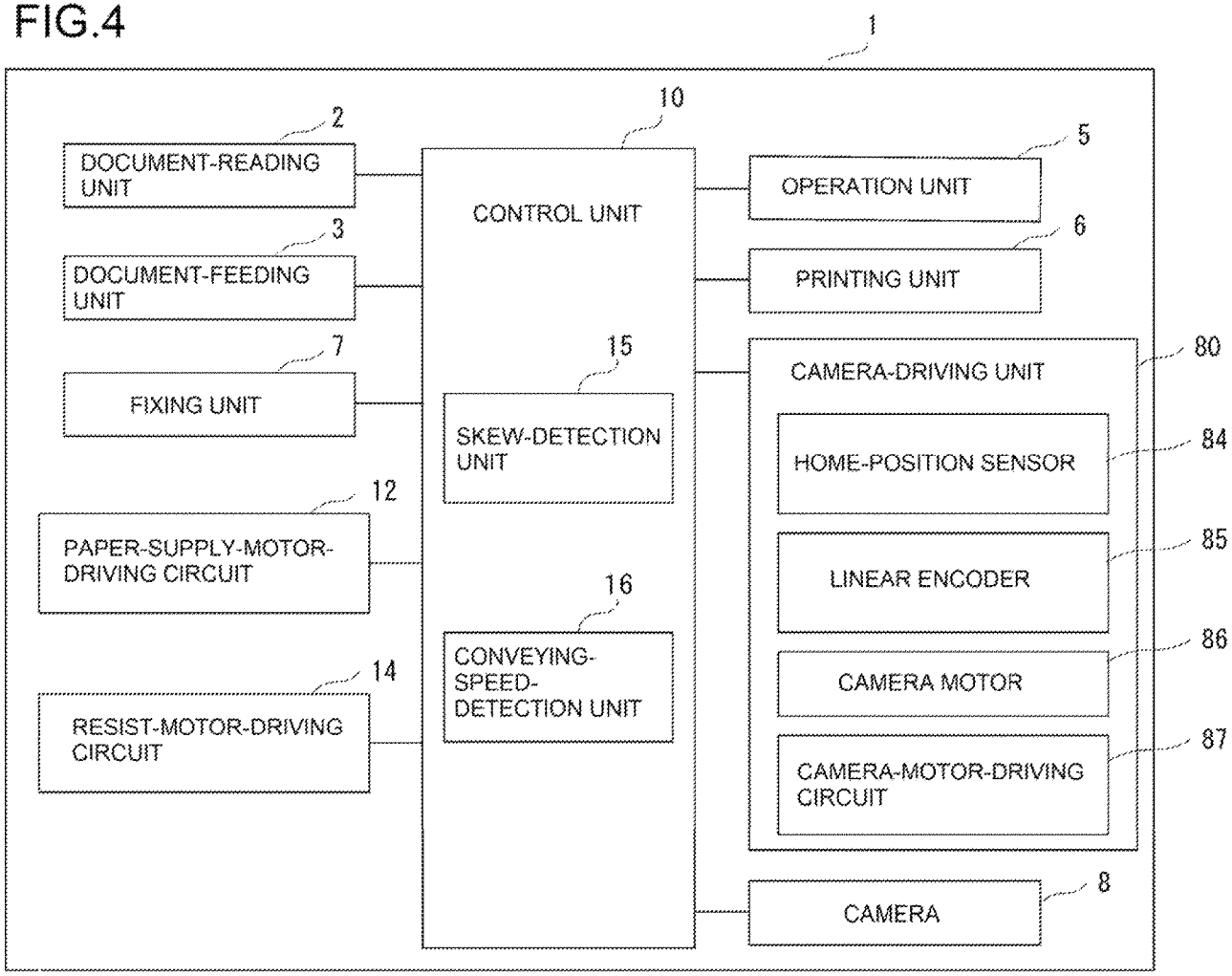
FIG. 4 is a schematic block diagram illustrating the configuration of an embodiment of an image-forming apparatus according to the present disclosure.

FIG. 4 illustrates a block diagram that illustrates the configuration of the image-forming apparatus 1. The document-reading unit 2, the document-feeding unit 3, the operation unit 5, the printing unit 6, the fixing unit 7, the camera 8 and the camera-driving unit 80 described above are connected to a control unit 10, and the respective operation is controlled by the control unit 10. Moreover, a paper-supply-motor-driving circuit 12 that controls the rotation of the pickup roller 42 and the paper-supply roller 43 and a resist-motor-driving circuit 14 that controls the rotation of the resist roller 44 are also connected to the control unit 10.

The control unit 10 is an information-processing unit such as a microcomputer or the like that includes a CPU (Central Processing Unit), ROM (Read Only Memory), RAM (Random Access Memory) and the like. The ROM stores a control program for performing control of the operation of the image-forming apparatus 1. The CPU of the control unit 10 performs overall control of the apparatus by reading the control program that is stored in the ROM, expanding the control program in the RAM, and executing the control program. Moreover, the control unit 10 functions as a skew-detection unit 15 and conveying-speed-detection unit 16 by executing the control program.

Figure 5:
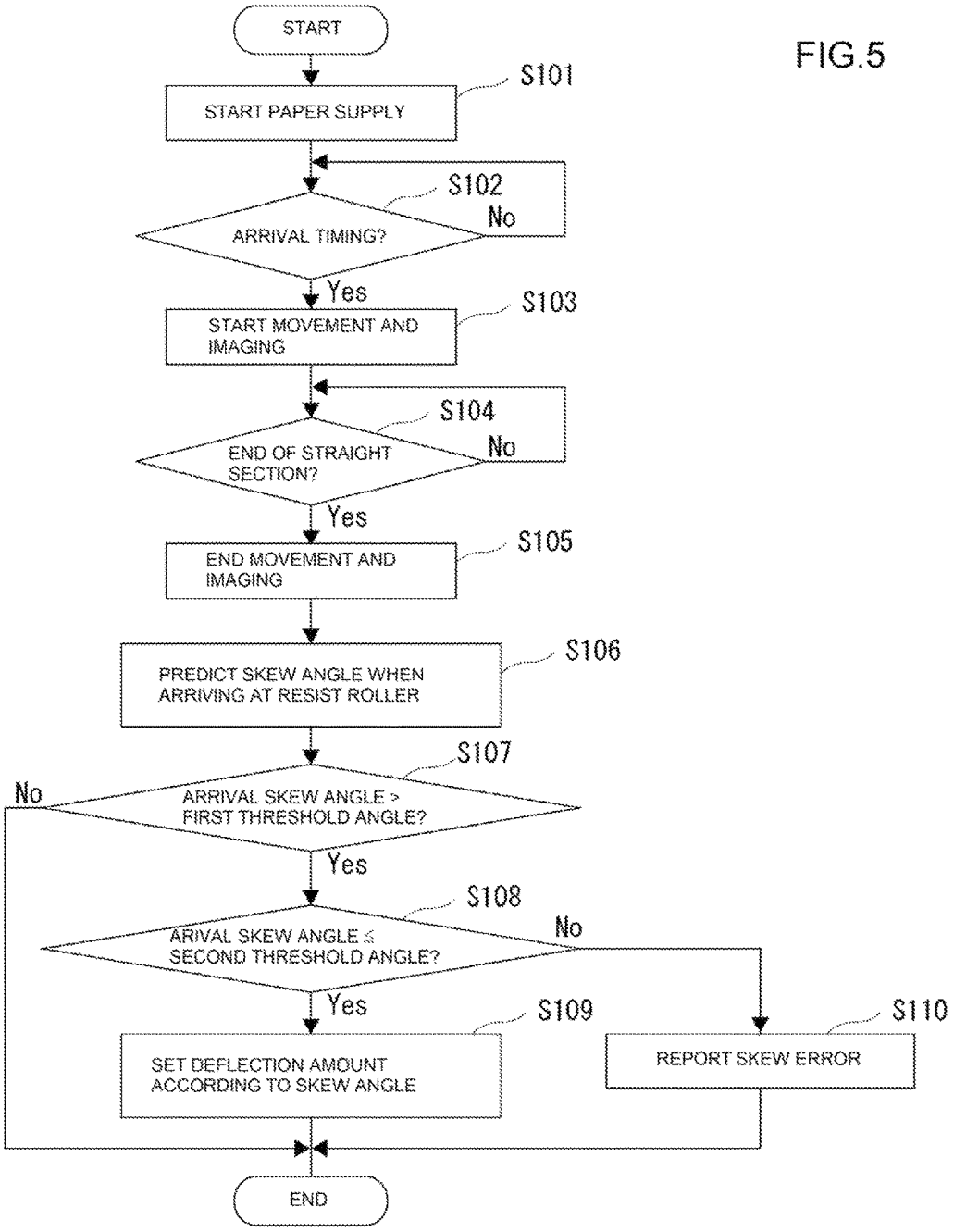
FIG. 5 is a flowchart illustrating a skew-detection operation by the skew-detection unit illustrated in FIG. 3.

Next, the skew-detection operation by the skew-detection unit 15 will be explained in detail with reference to FIG. 5 to FIG. 7.

When printing is instructed from the operation unit 5 or the like, the control unit 10 instructs the paper-supply-motor-driving circuit 12 to start supplying paper, and the supply of paper is started by the paper-supply-motor-driving circuit 12 (step S101). The paper-supply-motor-driving circuit 12 feeds one sheet of printing paper P from the paper-supply unit 41 by causing the pickup roller 42 to rotate, and conveys the one sheet of printing paper P that is fed from the paper-supply unit 41 toward the resist roller 44 by causing the paper-supply roller 43 to rotate.

Next, the control unit 10 waits for the designed timing when the edge of the front end of the printing paper P that is starting to be supplied reaches the reference line L of the imaging range E of the camera 8 that is positioned at the home position (step S102). At the designed timing when the edge of the front end of the printing paper P reaches the reference line L, the control unit 10 instructs the camera-driving unit 80 to start moving the camera 8, and causes the camera 8 to start taking images (step S103). The camera-driving unit 80 causes the camera 8 to move at the designed conveying speed for the printing paper P by the paper-supply roller 43.

Next, the control unit 10 waits for the camera 8 to reach the end point of the flat-conveying section S (step S104), and when the camera 8 reaches the end point of the flat-conveying section S, the control unit 10 causes movement of the camera and imaging to end (step S105). After movement ends in step S105, the camera-driving unit 80 returns the camera 8 to the home position at specified timing.

Next, the control unit 10 functions as a skew-detection unit 15. The skew-detection unit 15, by analyzing images taken by the camera 8 in the flat-conveying section S, detects the skew angle (hereafter, called the arrival skew angle) when the edge of the front end of the printing paper P arrives at the resist roller 44 (step S106). Detection of the skew angle in step S107 is performed based on change in the skew angle in the flat-conveying section S.

Figure 6:
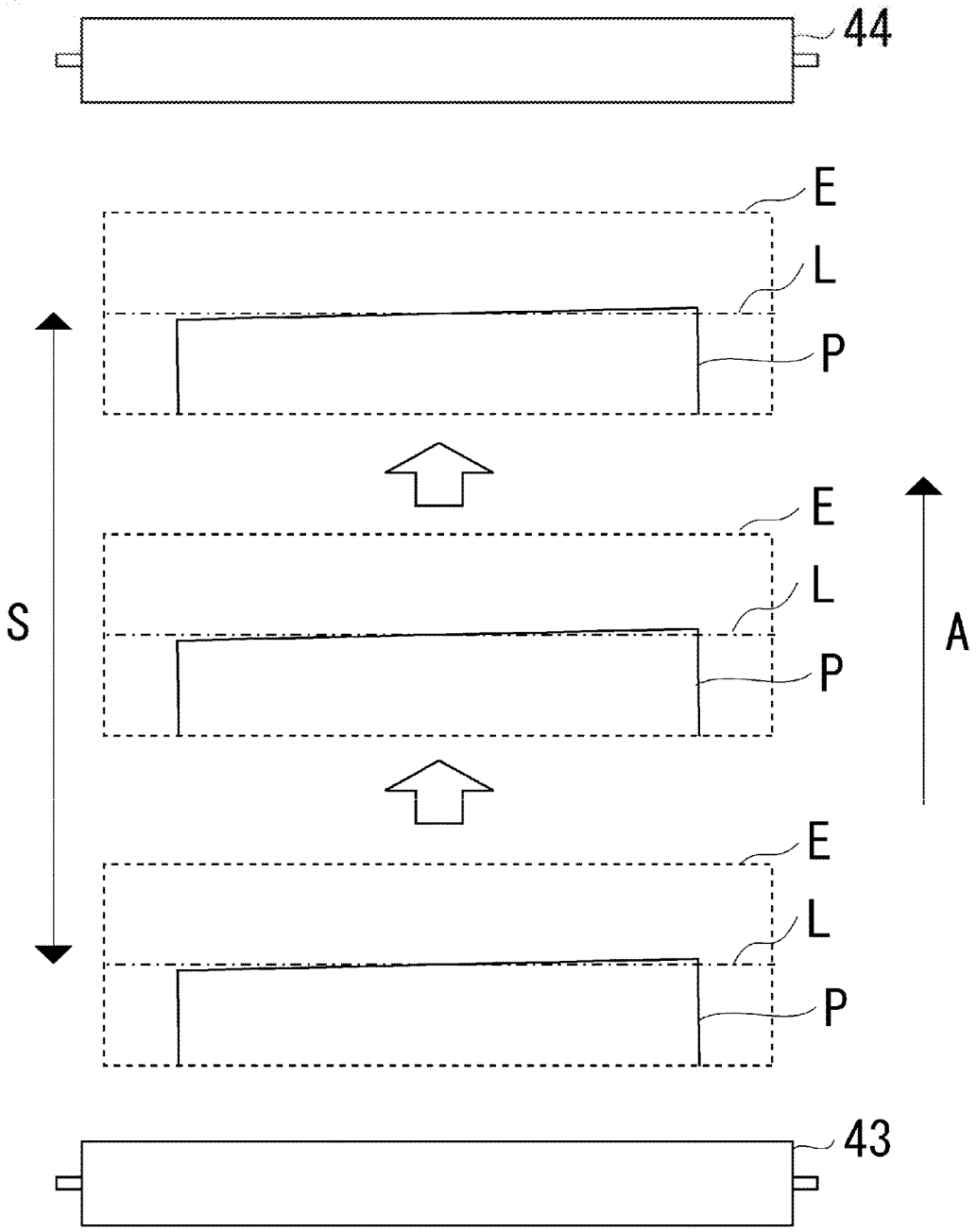
FIG. 6 is an explanatory diagram for explaining the skew-detection operation by the skew-detection unit illustrated in FIG. 3.
Figure 7:
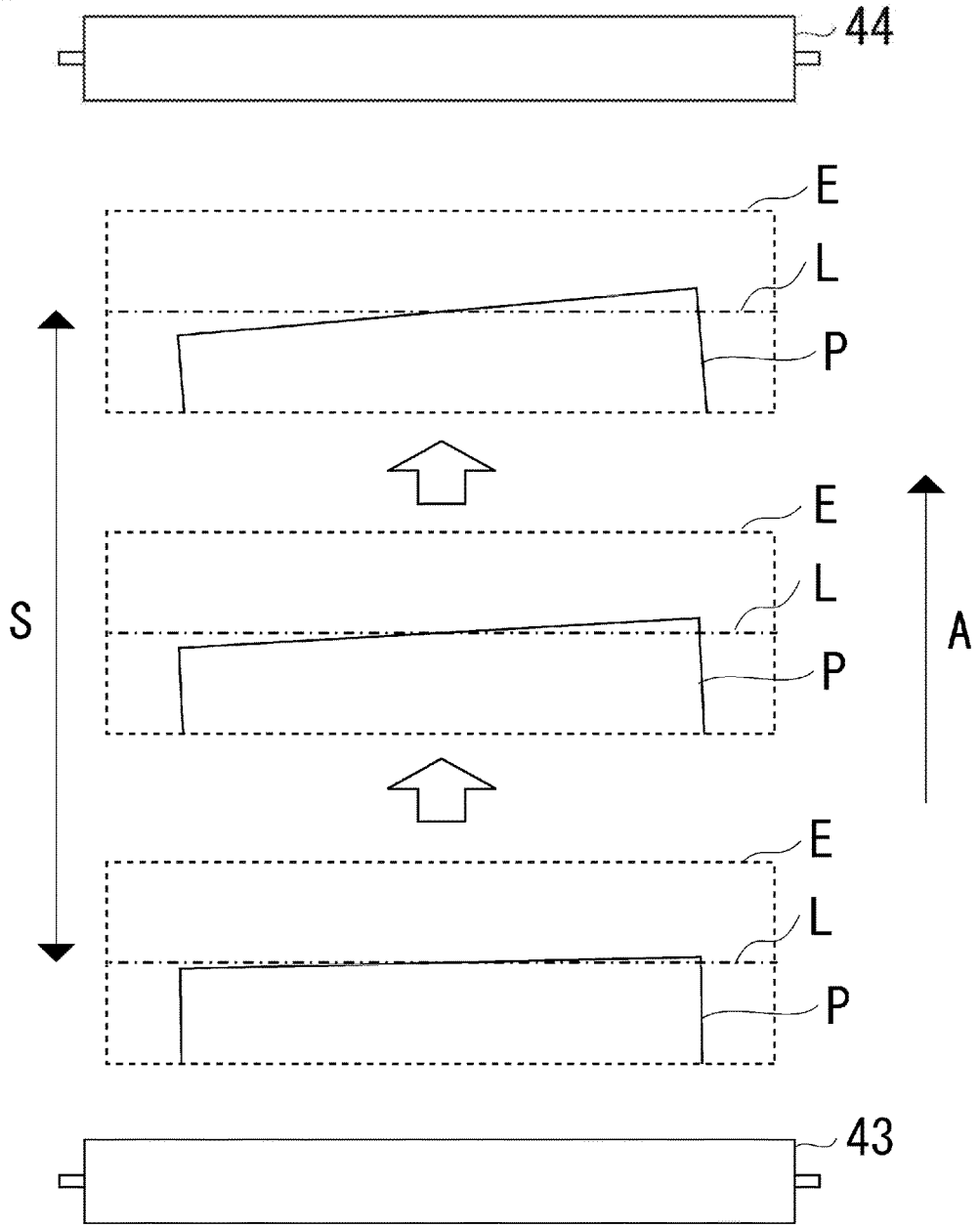
FIG. 7 is an explanatory diagram for explaining the skew-detection operation by the skew-detection unit illustrated in FIG. 3.

For example, as illustrated in FIG. 6, when there is no change in the skew angle in the flat-conveying section S, the skew angle that is detected in the flat-conveying section S is detected as the arrival skew angle. Moreover, as illustrated in FIG. 7, when the skew angle gradually becomes larger in the flat-conveying section S, the amount of change in the skew angle is calculated according to the conveying distance. Then, based on the calculated amount of change, the amount of skew that is to be added from the end point of the flat-conveying section S until arriving at the resist roller 44 is calculated, and the arrival skew angle is detected by adding that value to the skew angle at the end point of the flat-conveying section S.

Next, the skew-detection unit 15 determines whether or not the arrival skew angle in step S106 is greater than a preset first threshold angle (step S107). In step S107, when the arrival skew angle is equal to or less than the first threshold angle, the skew-detection unit 15 ends the skew-detection operation. As a result, the resist-motor-driving circuit 14 brings the printing paper P in contact with the resist roller 44 and causes the resist roller 44 to start rotating at timing when a preset set amount of deflection can be made. The skew is corrected by this deflection that is made in the printing paper P. The first threshold angle is a skew angle for which correction by the set amount of deflection is possible.

In step S107, when the arrival skew angle is greater than the first threshold angle, the skew-detection unit 15 determines whether or not the arrival angle is equal to or less than a second threshold angle that is larger than the first threshold angle (step S108). The second threshold angle is deflection that can be made in the printing paper P by the resist roller 44, and is the upper limit of the skew angle for which skew correction can be performed.

In step S108, when the arrival skew angle is equal to or less than the second threshold angle, the skew-detection unit 15 sets an amount of correction deflection that is larger then the initial deflection amount according to the arrival skew angle, and notifies the resist-motor-driving circuit 14 of the set amount of correction deflection (step S109). As a result, the resist-motor-driving circuit 14 executes skew correction by delaying the start of rotation of the resist roller 44 to be later than the preset timing, and creating an amount of a correction deflection amount by the resist roller 44.

In step S108, when the arrival skew angle is greater than the second threshold angle, the skew-detection unit 15 notifies of skew error via the touch panel of the operation unit 5 or the like (step S110). When notifying of a skew error, the generating source of the skew is identified based on the change in the skew angle in the flat-conveying section S, and it is possible to notify of the identified skew generating source as well. For example, at the home position, when the skew angle is greater than the second threshold angle, the inclination of the printing paper P that is stored in the paper-supply unit 41, or the operation of feeding paper by the pickup roller 42 is identified as the skew generating source. Moreover, as illustrated in FIG. 7, when the skew angle gradually becomes larger in the flat-conveying section S, the conveying operation by the paper-supply roller 43 is identified as the skew generating source.

The skew-detection operation by the skew-detection unit 15 may be executed each printing of one sheet, or may be executed every specified number of sheets. Moreover, the skew-detection operation may be executed when performing the first printing after startup, or may be executed for the first printing after opening and closing the paper-supply unit 41 (after refilling with printing paper P).

Figure 8:
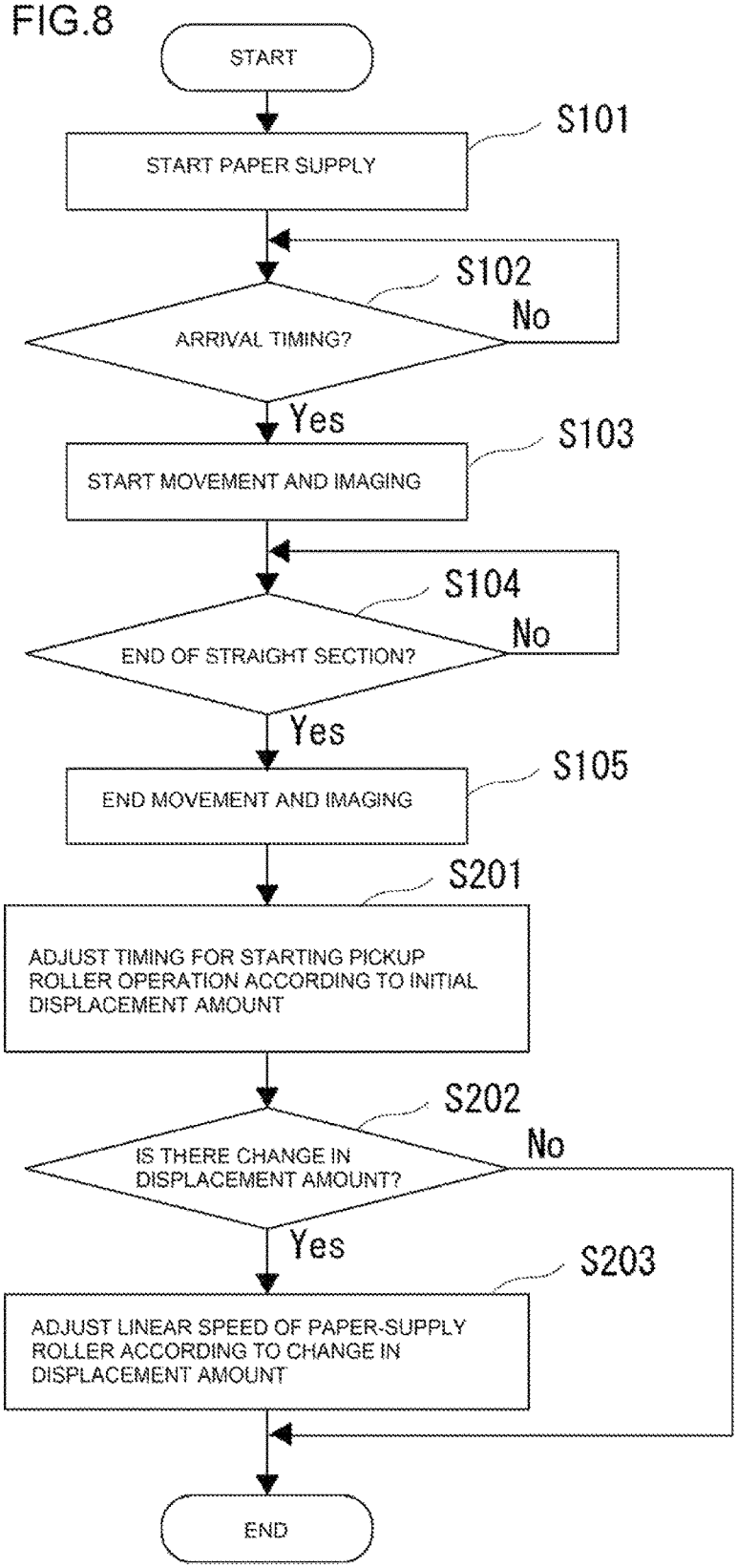
FIG. 8 is a flowchart illustrating a conveying-speed-detection operation by the conveying-speed-detection unit illustrated in FIG. 3.
Figure 9:
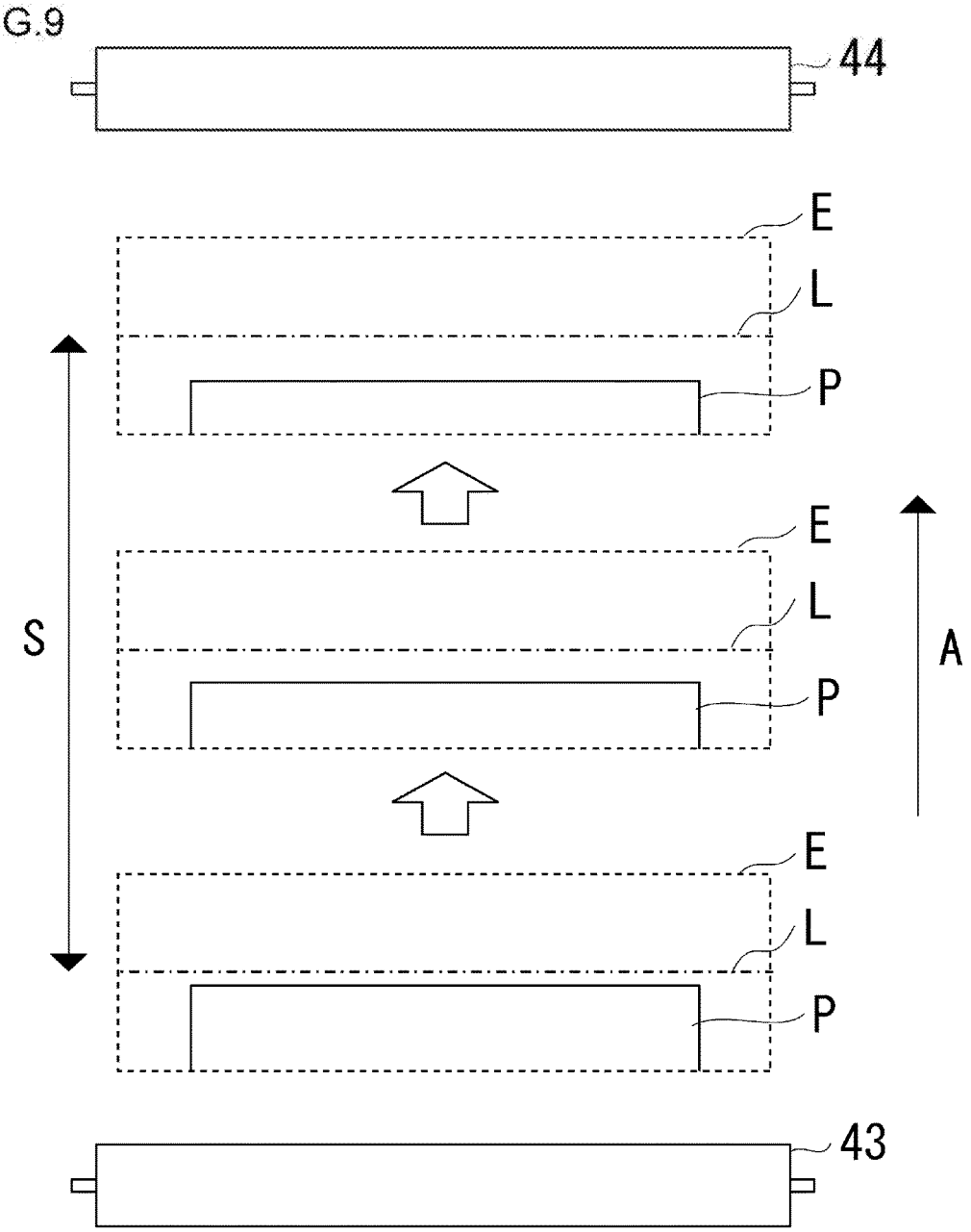
FIG. 9 is an explanatory diagram for explaining the conveying-speed-detection operation by the conveying-speed-detection unit illustrated in FIG. 3.

Next, the conveying-speed-detection operation by the conveying-speed-detection unit 16 will be explained in details with reference to FIG. 8 and FIG. 9.

Similar to the skew-detection operation by the skew-detection unit 15, the conveying-speed-detection operation by the conveying-speed-detection unit 16 is executed based on images of the flat-conveying section S taken by the camera 8 in step S101 to step S105.

Following step S105, the control unit 10 functions as the conveying-speed-detection unit 16. The conveying-speed-detection unit 16, by analyzing the images taken by the camera 8 that is positioned at the home position, adjusts the timing for starting operation of the pickup roller 42 according to the amount of initial displacement between the edge of the front end of the printing paper P and the reference line L at the home position (step S201). The adjustment in step S201 is reflected starting from the next printing operation. As illustrated in FIG. 8, when the edge of the front end of the printing paper P has not reached the reference line L, adjustment is performed to quicken the timing for starting the operation of the pickup roller 42, and when the edge of the front end of the printing paper P is passed the reference line L, adjustment is performed to slow the timing for starting the operation of the pickup roller 42.

Next, the conveying-speed-detection unit 16, by analyzing the images taken by the camera 8 in the flat-conveying section S, determines whether or not the amount of displacement between the edge of the front end of the printing paper P and the reference line L at the home position is changed (step S202). In step S202, when the amount of displacement is not changed, the conveying-speed-detection unit 16 ends the conveying-speed-detection operation.

In step S202, when the amount of displacement is changed, the conveying-speed-detection unit 16 adjusts the linear speed of the paper-supply roller 43 according to the change in the amount of displacement (step S203), and then ends the conveying-speed-detection operation. The adjustment in step S203 is reflected starting from the next printing operation. As illustrated in FIG. 8, when there is displacement of the edge on the front end of the printing paper P toward the front side (direction opposite the conveying direction) with respect to the reference line L, the conveying-speed-detection unit 16 performs adjustment to quicken the linear speed of the paper-supply roller 43, and when there is displacement of the edge on the front end of the printing paper P in the forward direction (conveying direction) with respect to the reference line L, performs adjustment to slow the linear speed of the paper-supply roller 43.

The conveying-speed-detection operation by the conveying-speed-detection unit 16 may be executed each printing of one sheet, or may be executed every specified number of sheets. Moreover, the conveying-speed-detection operation may be executed when performing the first printing after startup, or may be executed from the first printing after opening and closing the paper-supply unit 41 (after refilling with printing paper P).

Furthermore, the imaging range E of the camera 8 is set to be equal to or greater than the width of the printing paper P that is conveyed in the flat-conveying section S, so it is also possible to detect the size of the printing paper P using the images taken by the camera 8.

As explained above, in the image-forming apparatus according to this embodiment, the power-supply roller 43 conveys the printing paper P that is fed from the paper-supply unit 41 by the pickup roller 42 toward the resist roller 44, the resist roller 44 supplies the printing paper P to the printing unit 6 at specified timing, and the printing unit 6 performs printing on the printing paper P. The image-forming apparatus includes a flat-conveying section S, a camera 8, a camera-driving unit 80 and a skew-detection unit 15. The flat-conveying section S is formed by the conveying path for the printing paper P between the paper-supply roller 43 and the resist roller 44, and conveys the printing paper P in a flat state. The camera 8 takes images of the edge of the front end of the printing paper P that is conveyed in the flat-conveying section S. The camera-driving unit 80 causes the camera 8 to move along the flat-conveying section S at the designed speed of the printing paper P. The skew-detection unit 15, based on images taken in the flat-conveying section S by the camera 8, detects the skew angle when arriving at the resist roller 44 as the arrival skew angle.

With this configuration it is possible to accurately detect the skew angle when arriving at the resist roller 44, and thus it becomes possible to perform suitable skew correction according to the detected skew angle.

Furthermore, in this embodiment, when the skew angle does not change in the flat-conveying section S, the skew-detection unit 15 detects the skew angle that is detected in the flat-conveying section S as the arrival skew angle. When the skew angle gradually becomes larger in the flat-conveying section S, the skew-detection unit 15 calculated the amount of change in the skew angle according to the conveying distance. Then, based on the calculated amount of change, the skew-detection unit 15 detects the arrival skew angle by calculating the amount of skew to be added from the end point of the flat-conveying section S until arriving at the resist roller 44, and adding that amount to the skew angle at the end of the flat-conveying section S.

With this configuration, it is possible to accurately detect the skew angle when arriving at the resist roller 4 according to the change in skew angle in the flat-conveying section S.

Moreover, in this embodiment, there is a resist-motor-driving circuit 14 that starts the rotation of the resist roller 44 at timing when the printing paper P comes in contact with the resist roller 44 and it is possible to create a set deflection. When the arrival skew amount is greater than a first threshold angle for which correction by the set amount of deflection is possible and equal to or less than a second threshold angle, the skew-detection unit 15 notifies the resist-motor-driving circuit 14 of a correction-deflection amount that is larger than the initial deflection amount. After being notified of the correction-deflection amount, the resist-motor-driving circuit 14 causes the resist roller 44 to start rotating at timing at which the correction-deflection amount can be made.

With this configuration, it is possible to execute skew correction using a suitable deflection amount according to the detected skew angle.

Furthermore, in this embodiment, when the arrival skew amount is greater than a second threshold angle, the skew-detection unit 15, based on change in the skew angle in the flat-conveying section S, identifies the generating source of the skew, and reports a skew error together with the identified generating source of the skew.

With this configuration, it is possible to take immediate measures against the identified generating source of the skew, and to quickly execute handling of the error.

Furthermore, in this embodiment, there is a conveying-speed-detection unit 16 that based on images taken in the flat-conveying section S by the camera 8 detects the conveying speed of the printing paper P by the paper-supply roller 43.

With this configuration, it is possible to accurately detect the actual conveying speed of the printing paper P by the paper-supply roller 43, and thus it is possible to adjust the linear speed of the paper-supply roller 43.

When performing correction of skew by creating deflection by the resist roller, the optimum value of the deflection amount depends on the skew angle (amount of inclination) of the printing paper. Therefore, it is preferable that the amount of deflection be set based on the skew angle, however, it is difficult to accurately detect the skew angle when arriving at the resist roller. In other words, in typical technology, two sensors that are arranged at intervals in the width direction are used for detection of the skew angle, however, the detected skew angle is the skew angle at the point where the sensors are arranged and is not the skew angle when arriving at the resist roller.

According to the technology of the present disclosure it is possible to accurately detect the skew angle when arriving at the resist roller.

The present disclosure is not limited to the embodiments described above, and it is clear that it is possible to make various modifications to the embodiments within the range of the technical scope of the present disclosure. Moreover, the number, position, shape and the like of the components are not limited to that of the embodiments above, and a suitable number, position, shape and the like can be used for embodying the technology of the present disclosure. In the drawings, the same reference numbers are used for components that are the same.

What is claimed is:

1. An image-forming apparatus in which a paper-supply roller conveys printing paper that is fed from a paper-supply unit by a pickup roller toward a resist roller, the resist roller feeds the printing paper to a printing unit at specified timing, and the printing unit performs printing on the printing paper; the image-forming apparatus comprising:

a flat-conveying section that is formed by a conveying path for the printing paper between the paper-supply roller and the resist roller, and in which the printing paper is conveyed in a flat state;

a camera that takes images of the edge of the front end of the printing paper that is conveyed in the flat-conveying section;

a camera-driving apparatus that causes the camera to move along the flat-conveying section at a designed speed for the printing paper; and a skew-detection unit that, based in the images taken in the flat-conveying section by the camera, detects a skew angle when arriving at the resist roller to determine an arrival skew angle, wherein when the skew angle does not change in the flat-conveying section, the skew-detection unit detects the skew angle that is detected in the flat-conveying section as the arrival skew angle, and when the skew angle in the flat-conveying section gradually becomes larger, detects the arrival skew angle by calculating the amount of change in the skew angle according to the conveying distance, based on the calculated amount of change, calculating an amount of skew that is to be added from the end point of the flat-conveying section until reaching the resist roller, and adding the skew amount to the skew angle at the end point of the flat-conveying section.

2. An image-forming apparatus in which a paper-supply roller conveys printing paper that is fed from a paper-supply unit by a pickup roller toward a resist roller, the resist roller feeds the printing paper to a printing unit at specified timing, and the printing unit performs printing on the printing paper; the image-forming apparatus comprising:

a flat-conveying section that is formed by a conveying path for the printing paper between the paper-supply roller and the resist roller, and in which the printing paper is conveyed in a flat state;

a camera that takes images of the edge of the front end of the printing paper that is conveyed in the flat-conveying section;

a camera-driving apparatus that causes the camera to move along the flat-conveying section at a designed speed for the printing paper;

a skew-detection unit that, based in the images taken in the flat-conveying section by the camera, detects a skew angle when arriving at the resist roller to determine an arrival skew angle; and a resist-motor-driving circuit that causes the resist roller to rotate at timing at which the printing paper comes in contact with the resist roller and a set deflection amount can be created; wherein when the arrival skew angle is greater than a first threshold angle for which correction by the set deflection amount is possible and less than or equal to an upper limit second threshold angle, the skew-detection unit notifies the resist-motor-driving circuit of a correction-deflection amount that is larger than the initial deflection amount; and after being notified of the correction-deflection amount, the resist-motor-driving circuit causes the resist roller to rotate at timing at which the correction-deflection amount can be created.

3. The image-forming apparatus according to claim 2, wherein when the arrival skew angle is greater than the second threshold value, the skew-detection unit, based on the change in the skew angle in the flat-conveying section, identifies the generating source of the skew, and together with reporting the identified generating source of the skew, reports a skew error.

4. An image-forming apparatus in which a paper-supply roller conveys printing paper that is fed from a paper-supply unit by a pickup roller toward a resist roller, the resist roller feeds the printing paper to a printing unit at specified timing, and the printing unit performs printing on the printing paper; the image-forming apparatus comprising:

a flat-conveying section that is formed by a conveying path for the printing paper between the paper-supply roller and the resist roller, and in which the printing paper is conveyed in a flat state;

a camera that takes images of the edge of the front end of the printing paper that is conveyed in the flat-conveying section;

a camera-driving apparatus that causes the camera to move along the flat-conveying section at a designed speed for the printing paper;

a skew-detection unit that, based in the images taken in the flat-conveying section by the camera, detects a skew angle when arriving at the resist roller to determine an arrival skew angle; and a conveying-speed-detection unit that detects the conveying speed of the printing paper by the paper-supply roller based on images taken in the flat-conveying section by the camera.

* * * * *